United States Patent [19]

May

[11] 4,265,962

[45] May 5, 1981

[54] LOW PENETRATION COATING FABRIC

[75] Inventor: Robert E. May, Pleasant Garden, N.C.

[73] Assignee: Burlington Industries, Inc., Greensboro, N.C.

[21] Appl. No.: 752,303

[22] Filed: Dec. 20, 1976

[51] Int. Cl.[3] ..... B32B 27/34

[52] U.S. Cl. ..... 428/287; 427/412; 427/393.4; 428/90; 428/252; 428/265; 428/272; 428/284; 428/290; 428/310; 428/321; 428/913

[58] Field of Search ..... 427/394, 390 E, 412, 427/381, 365; 428/245, 265, 272, 290, 421, 422, 913, 252, 287, 284, 90, 310, 321

[56] References Cited

U.S. PATENT DOCUMENTS

| | | | |
|---|---|---|---|
| 3,326,713 | 6/1967 | Smith et al. | 427/412 |
| 3,535,156 | 10/1970 | Turner | 427/390 E |
| 3,540,924 | 11/1970 | Rozek et al. | 427/390 E |
| 4,004,059 | 1/1977 | Deiner et al. | 427/390 E |
| 4,007,305 | 2/1977 | Kakar et al. | 427/390 E |

*Primary Examiner*—James J. Bell

*Attorney, Agent, or Firm*—Cushman, Darby & Cushman

[57] ABSTRACT

An improved aqueous coating substrate is obtained when water repellency is incorporated into a coating substrate finish. Show-through of an aqueous finish during coating is prevented without loss of adhesion of the cured coating to the fabric. The water repellency of the improved substrate prevents migration of the aqueous coating into the fabric, causing the coating to remain on the fabric surface.

12 Claims, 5 Drawing Figures

LOW PENETRATION COATING FABRIC

BACKGROUND OF THE INVENTION

The invention relates to a method of reducing or preventing "show-through" of an aqueous coating on a fabric substrate. "Show-through" of an aqueous coating on a fabric substrate is defined as penetration of the aqeous coating into the fabric, the penetration extending to the uncoated side of the fabric.

Suitable aqueous coatings include latex coatings, which are water emulsions of a polymer. Any aqueous coating which is used as a textile fabric coating is contemplated within the scope of the present invention. Such coatings include aqueous textile adhesive coatings, aqueous textile foam coatings, etc. As those in the art are aware, the composition of an aqueous textile coating will depend upon the ultimate use for which the coated substrate is intended.

The fabric which is the base of the improved low penetration coating fabric of the present invention may be selected from a wide variety of woven and non-woven fabrics. In general, any woven or non-woven fabric may be used as a base in preparing the coating substrates of the present invention, provided that the fabric does not contain apertures so large that they are unable to support the aqueous coating. Suitable fabrics for use in the present invention include non-woven fabrics of nylon, polyester, and spun rayon and woven and knitted fabrics of cotton, rayon, nylon, polyester, and other synthetic fibers. In general, any of the fabrics traditionally used as coating substrates may be used in the practice of the present invention. Such traditional coating substrates include, for example, twills, drills, sateens, sheetings, and ducks. Drapery backing and flocking base, which are sheetings, are especially contemplated for use in the practice of the present invention.

The aqueous nature of aqueous textile coatings tends to cause an aqueous coating to migrate into the fabric surface, thus causing show-through of the coating. Such show-through of the coating material into a fabric substrate produces a stiff product with an unattractive appearance. Furthermore, show-through of the coating material into the fabric substrate results in inefficient utilization of the coating material, and of the apparatus used to apply the coating material to the fabric substrate, since more than one application of coating material to the substrate may be required to produce the desired surface coating.

SUMMARY OF THE INVENTION

When aqueous coating material has been applied to a fabric substrate in the past, the aqueous nature of the coating has caused the material to tend to migrate into the fabric, thus causing show-through. The present invention provides for the production of a low penetration coating fabric obtained by incorporating water repellency into a substrate finish. By incorporating a water repellent composition into a coating fabric, it has been found that show-through of aqueous textile coatings is reduced or prevented without loss of adhesion of the coating to the fabric substrate. By treating the fabric substrate in accordance with the present invention, the water repellency of the improved fabric substrate prevents migration of an aqueous coating material into the fabric substrate.

It is therefore an object of the present invention to provide an improved fabric substrate exhibiting increased water repellency resulting in reduced penetration of an aqueous coating material into the fabric substrate.

Another object of the present invention is to provide an improved fabric substrate which prevents show-through of an aqueous coating material during the coating operation without loss of adhesion of the coating to the fabric substrate.

Another object of the present invention is to provide an improved fabric substrate which is softer and exhibits more supple "drape". "Drape" is defined in the American Cotton Handbook, 3rd ed., vol. 2, p. 1143 (1966).

Another object of the present invention is to provide improved coated fabrics which, by preventing show-through are visually more attractive.

Yet, another object of the present invention is to enhance the efficient use of an aqueous coating material and the efficient operation of coating equipment by eliminating the need for a multiple step coating processes, since the improved fabric substrate of the present invention produces a superior surface coating in a single step.

It has been found that the objects of the present invention can be satisfied by treating a fabric substrate with a fluoro chemical composition to impart water repellency to the fabric substrate.

DETAILED DESCRIPTION OF THE INVENTION

Figures 1, 2, 3, 4, 5:
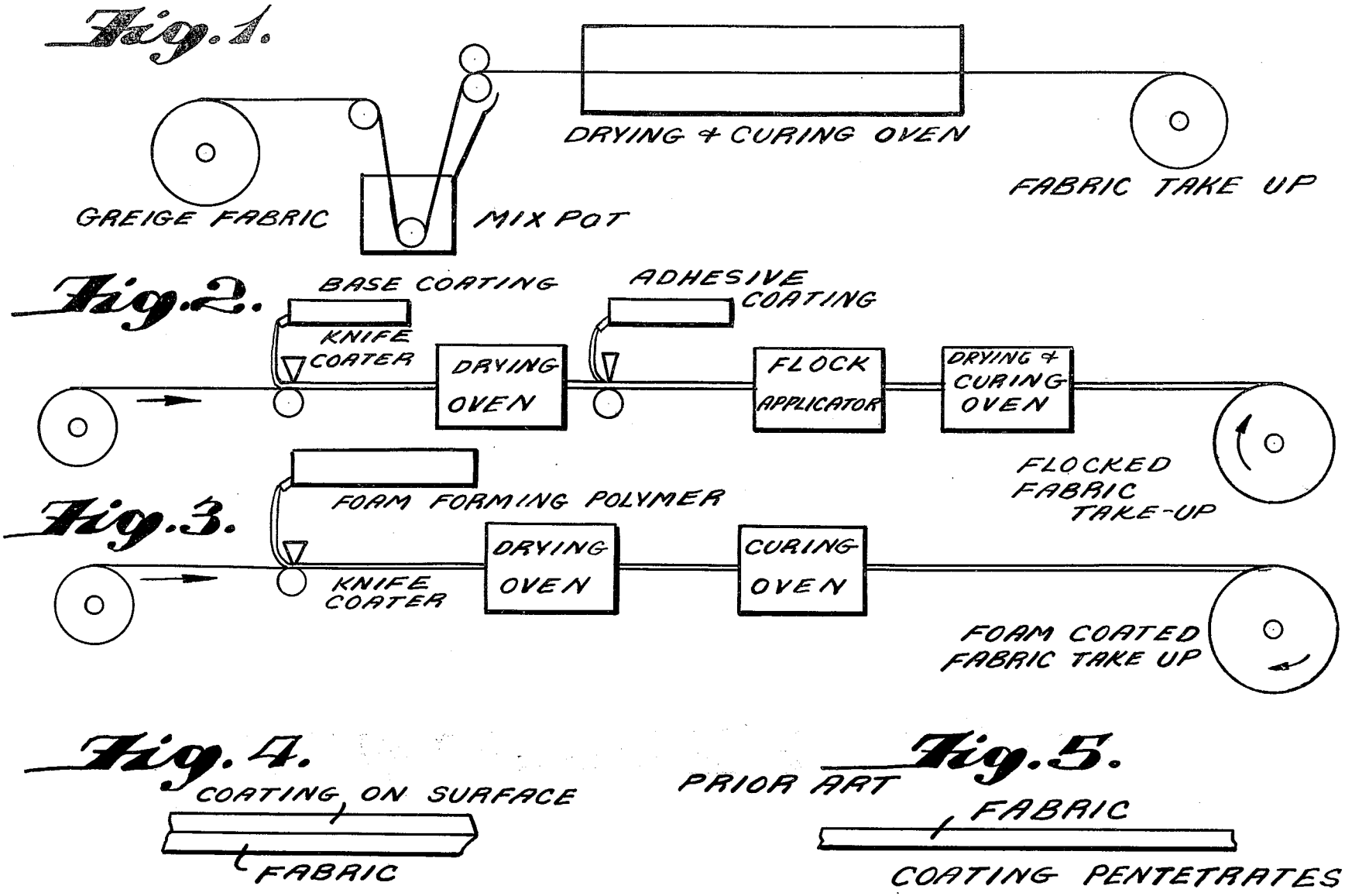
FIG. 1 illustrates the process according to the present invention of preparing an improved fabric coating substrate. The greige fabric is passed through a mix pot containing inter alia a fluoro chemical compound to impart water repellency to the greige fabric. After excess solution is squeezed from the greige fabric, it is passed through a drying and curing oven. The fabric so produced is the improved low penetration coating fabric according to the present invention.
FIG. 2 illustrates a process of using the improved low penetration coating fabric of the present invention. The improved coating substrate, prepared according to the process illustrated in FIG. 1, is passed under a feed tank containing a supply of a base coat which is applied to the fabric by means of a knife coater. It will, of course, be understood that a doctor blade or reverse rolls or other coating mechanism could be used in place of the knife coater. The coated fabric is then passed through a drying oven. After passing through the drying oven, it is passed under a feed tank containing a supply of adhesive which is applied to the fabric by means of a knife coater. Again, it will be understood that other equivalent coating mechanisms could be used in place of the knife coater. Flock is then applied to the fabric and the flocked fabric is passed through a drying and curing oven to produce a coated fabric exhibiting the advantages which result from using the improved low penetration coating fabric of the present invention.
FIG. 3 illustrates another process of using the improved coating substrate of the present invention. The improved coating substrate, prepared according to the process illustrated in FIG. 1, is passed under a feed tank containing a supply of foam forming polymer, as described in U.S. Pat. No. 3,527,654 to R. L. Jones and W. A. Brandon, which is hereby incorporated by reference. The foam forming polymer is supplied to the improved coating substrate by means of a knife coater. Again, it will, of course, be understood that a doctor blade or reverse rolls or other coating mechanism could be used in place of the knife coater. The foam coated fabric is then passed through a drying oven and a curing oven to produce a foam coated fabric exhibiting the advantages which result from the improved coating substrate of the present invention.
FIG. 4 illustrates a cross-section of a coated fabric produced according to the process illustrated in FIG. 3. It will be noted that the coating does not penetrate the fabric, but rather remains on the surface of the fabric.
FIG. 5 illustrates a cross-section of a coated fabric produced by a prior art process. It will be noted that in prior art processes, the coating penetrates into the fabric substrate rather than remaining on the surface of the fabric substrate.

The present invention provides an improved low penetration coating fabric obtained by incorporating water repellency into a coating fabric finish. The fabric which is used to prepare the improved coating substrate may be selected from a wide variety of woven and non-woven fabrics. Suitable non-woven fabrics may, for example, include polyester fabrics of 100% polyester, as well as blends of polyester with minor amounts of other fibers, e.g., rayon or cotton, in amounts up to about 20% by weight. The polyester may be textured or non-textured. The non-woven fabric preferred according to the present invention is a polyester spunlaced non-woven fabric having a fiber entanglement completeness of at least 0.5, which may be produced by any of the methods described in the following United States Patents:

U.S. Pat Nos. 3,434,188 filed by R. J. Summers; 3,485,706 filed by F. J. Evans; 3,485,708 filed by J. W. Ballou; 3,485,709 filed by F. J. Evans; 3,486,168 filed by F. J. Evans; 3,493,462 filed by W. W. Bunting; 3,494,821 filed by F. J. Evans; 3,498,874 filed by F. J. Evans; 3,508,308 filed by W. W. Bunting.

Each of the above listed patents is hereby incorporated by reference. For example, U.S. Pat. No. 3,485,706 discloses a wide variety of textile-like non-woven spunlaced fabrics which are produced by traversing fibrous material with high-energy liquid streams while being supported on an apertured member, such as a perforated plate or woven wire screen, to consolidate the material in a repeating pattern of entangled fiber regions and inter-connecting fibers. The fibers are randomly entangled in a manner which holds the fibers of the fabric in place without the necessity of bonding agents.

Suitable woven fabrics which may be used in the practice of the present invention include woven fabrics which are suitable for use as coating substrates. As mentioned above, wovens fabrics which are traditional coating substrates include: twills, drills, sateens, sheetings, and ducks. Although woven fabrics of cotton and cotton blends are the most commonly used woven coating substrates, woven fabrics of rayon, nylon, polyester, and blends thereof may also be use. Suitable woven fabrics are described by S. P. Suskind in the *Journal of Coated Fabrics,* vol. 1, pages 19 to 26 (1974), which is hereby incorporated by reference.

As mentioned above, any aqueous coating material may be used with the improved low penetration coating fabric of the present invention. For example, flock coatings and foam coatings, illustrated in FIGS. 2 and 3, are typical aqueous coating materials which may be used with the improved coating substrates of the present invention. For example, a foam coating material may be used selected from any known aqueous foam coating material. Such foam coating materials are typically organic polymer foamable materials, the polymer being rubber, polyurethane, polystyrene, vinyl polymers such as polyvinyl chloride, polyethylene, phenol-formaldehyde resins, urea-formaldehyde resins, melamine-formaldehyde resins, silicones and cellulose acetate, or others. A typical polymer which may be used in a polymeric foam to be applied to the improved coating substrate of the present invention is the cross-linked foamed copolymer of styrene and acrylic acid, or other hydrophilic acrylic polymer described in U.S. Pat. No. 3,215,647 to Dunn, the disclosure of which is hereby incorporated by reference. This is formed from a latex containing a copolymer of styrene with another monomer having a reactive group such as acrylic acid. The latex may also contain a coreactive material which cross-links the styrene polymer and which is soluble in water or water-miscible solvents. Other suitable aqueous foamed polymeric coating systems which may be used with the improved low penetration coating fabric substrates of the present invention are described in U.S. Pat. No. 3,748,217 to R. E. May, the specification of which is hereby incorporated by reference.

The compositions which impart water repellency to the low penetration coating fabric substrate according to the present invention may be selected from a wide range of water-proofing compositions which are known to impart water resistance to textile fabrics. For example, fluoro chemical compositions, silicones, waxes, and fatty acid waterproofing agents may all be used in the practice of the present invention. However, the use of a fluoro chemical waterproofing composition is preferred in the practice of the present invention. Suitable fluoro chemical compositions which impart water repellency to the fabric substrate according to the present invention may be selected from the entire range of fluoro chemical compositions which are known to impart water repellency. For example, the fluoro chemical compositions disclosed in U.S. Pat. Nos. 2,803,615 and 2,841,573, both to A. H. Ahlbrecht, may be used. These compositions, as well as many other suitable fluoro chemical compositions which may be used to impart water repellency to fabric substrates in accordance with the present invention are described by M. W. Ranney in *Waterproofing Textiles,* pages 184 to 300 (Noyes Data Corp., Park Ridge, N.J. 1970), which is hereby incorporated by reference. It must be emphasized that each of the preferred compositions which may be used to impart water repellency to a fabric substrate in accordance with the present invention is a fluoro chemical composition. Although there are other types of compositions which may be used to impart water repellency to a fabric substrate, it has been found that they are not as effective as fluoro chemical compositions in the practice of the present invention, and further that many of the other types of waterproofing compositions interfere with the subsequent adhesion of the cured coating to the fabric. A selection of suitable fluoro chemical compositions which may be used in the practice of the present invention is fully disclosed by M. W. Ranney, incorporated by reference above.

As those in the art are aware, these fluoro chemical compositions may be characterized as cationic compositions, anionic compositions, and nonionic compositions.

The selection of a particular fluoro chemical composition to impart water repellency in the practice of the present invention will be guided by the other materials which are present in the mix pot with the fluoro chemical composition to treat the greige vapor. That is, in the practice of the present invention, a greige fabric is passed through a mixture which, in addition to a fluoro chemical composition to impart water repellency, may contain other components to impart desirable chemical and mechanical properties to the greige fabric. For example, the mixture may contain components to stiffen the greige fabric, or to prepare the greige fabric to receive a dye. Typical added components which may be present in addition to a fluorochemical composition to impart water repellency include pigments, binders, dyes, and wetting agents. These other components of the mixture through which the greige fabric is passed do not impart water repellency to the greige fabric. However, these other components may interact with the fluoro chemical composition and hinder the water repellency function of the fluoro chemical composition. It is for this reason desirable to choose a fluorochemical composition which will not interact with the other components of the mix pot. In this regard, a preferred fluorochemical composition is Scotchgard F.C. 218, manufactured by the Minnesota Mining & Manufacturing Co., which is nonionic fluorochemical composition. An example of a preferred cationic fluorochemical composition is Scotchgard F.C. 208, also manufactured by the Minnesota Mining & Manufacturing Co. Another preferred cationic fluorochemical composition is Zepel 2373 manufactured by the E. I. du Pont de Nemours & Co. Still another preferred fluorochemical composition is Pentel, manufactured by the Pennwalt Corporation.

The water repellency imparted to the greige fabric to produce the low penetration coating substrate according to the present invention may be measured by AATCC Test Method 22-1974, as set forth in the *Technical Manual* of the American Association of Textile Chemists and Colorists, vol. 50, pages 223-24 (1974), which is hereby incorporated by reference. Water repellency is defined as the ability of a textile fabric to resist wetting. This test, known as the "Spray Test," is designed to measure the resistance of fabrics to wetting by water. The test is especially suitable for measuring the water-repellent efficacy of finishes applied to fabrics. Water sprayed against a taut surface of a test specimen under controlled conditions produces a wetted pattern whose size depends on the relative water repellency of the fabric. Evaluation is accomplished by comparing the wetted pattern with a standard chart. The higher the water repellency rating, measured by AATCC Test Method 22-1974, the better a textile fabric is able to resist wetting by water. Any fluorochemical composition which imparts a Spray Test water repellency rating of at least 70 to a greige fabric will produce an improved coating substrate which will reduce penetration of an aqueous coating material into the fabric substrate during coating in accordance with the present invention. However, in the practice of the present invention, it is preferred to use a fluorochemical composition which will impart a Spray Test water repellency rating of at least 80 to the treated greige fabric. In the most preferred practice of the present invention, the fluorochemical composition used will impart a Spray Test water repellency rating of from about 80 to about 100 to the treated greige fabric.

In the process of the present invention, a greige fabric is passed through a mix pot containing inter alia a fluorochemical composition to impart an AATCC Spray Test water repellency rating of at least 70 to the greige fabric. After excess solution is squeezed from the greige fabric, it is passed through a drying and curing oven. In general the drying and curing oven may be operated at a temperature from about 360° F. to about 400° F. The fabric so produced is the improved low penetration coating substrate according to the present invention. The improved fabric substrate of the present invention is subsequently coated with an aqueous coating material, as described above. The aqueous coating material is applied to the improved coating substrate in a conventional manner, using any conventional coating mechanism without any change in coating procedure. That is, treatment of the greige fabric with a fluorochemical composition in accordance with the present invention does not change the process of applying a subsequent coating. The coated fabric is subsequently cured. It is found that when a greige fabric is treated in accordance with the present invention to exhibit an AATCC Spray Test water repellency rating at least 70, that show-through of an aqueous coating material during coating is reduced or prevented. A surprising and unexpected advantage of the process of the present invention is that the fluorochemical treatment of the improved coating substrate does not impair the adhesion of the coating material subsequently applied to the substrate. This is a surprising and unexpected advantage since fluorochemical compositions of the type used in the present invention might be thought to increase the anti-stick properties of the treated fabrics. Thus, it is a surprising property of the improved coating substrates prepared according to the present invention that the adhesion of a subsequently applied coating material such as a foam coating or a flock coating is not impaired by the fluorochemical treatment of the greige fabric.

As discussed above, one of the objects of the present invention is to produce a coated fabric which is softer and exhibits more supple "drape". These properties are related to the stiffness of a fabric, which may be measured quantitatively by an apparatus known as a Digital Handle-O-Meter, Model 5, manufactured by the Thwing-Albert Instrument Co. of Philadelphia, Pa. As will be discussed below, when coated textile fabrics treated in accordance with the present invention were compared with coated textile fabrics which had not been treated in accordance with the present invention, it was found that the treated fabrics were less stiff (more supple) than untreated fabrics.

The present invention will be further illustrated by the following Examples, which are intended to be illustrative only and are meant to include all techniques equivalent thereto.

EXAMPLES

EXAMPLE 1

A greige fabric was passed through a mix pot containing ¼% by weight of Zepel R.S. (a fluorochemical composition manufactured by the E. I. du Pont de Nemours Co.), squeezed to remove excess liquid, and dried at 360° F. for 45 seconds. It was found that the fabric picked up 175% by weight of the fluorochemical composition, based on the dry weight of the fabric.

EXAMPLE 2

The procedure of Example 1 was repeated except that the treated greige fabric was dried at a temperature of 390° F. for 30 seconds.

EXAMPLE 3

An improved coating substrate according to the present invention can be coated with a foamable acrylic latex coating composed of (on a dry solid basis):

100 parts acrylic latex
6 parts ammonium stearate
30 parts titanium dioxide (a pigment)
45 parts talc (a filler)
0.6 parts Methocel MC 4000 (a thickener)

It will of course be understood that other pigments could be used, that clay or alumina could be used in place of talc as a filler, and that acrylates or gums, etc. could be used as a thickener in place of Methocel MC 4000 (which is believed to be a carboxymethylcellulose composition). The acrylic latex can be selected from any conventional acrylic latex, such as Rhoplex E269, Rhoplex HA8, and Rhoplex TR 934, all manufactured by the Rohm and Haas Co. These conventional acrylic latexes contain methyl acrylate, methyl methacrylate, and butyl acrylate. Acrylic latex coatings are formulated by mixing an acrylic latex as received, 15% ammonium stearate solution, solid pigment and filler as received, and a 3 or 4% solution of thickener in water.

The amount of coating material coated onto the improved coating substrate of the present invention will, of course, depend on the intended use of the coated substrate. In this experiment, 2 ounces of coating material per square yard of improved fabric substrate were knife coated with air onto water repellent fabric prepared in accordance with the present invention. The foam coated fabric was dried in an oven at a temperature of 280° F. for 45 seconds and cured in an oven at 350° F. for 30 seconds. It was found that the foam coated fabric did not show through the coating.

The stiffness of a fabric coated in accordance with Example 3, using an improved coating substrate according to the present invention, was compared with a comparably coated fabric which did not use an improved coating substrate. The stiffness of each fabric was measured with the Digital Handle-O-Meter mentioned above. The force required to deflect the fabric prepared in accordance with the present invention was found to be 51 units, whereas a force of 76 units was required to deflect the fabric which did not use an improved coating substrate. Thus, the fabric prepared in accordance with the present invention is less stiff (more supple) than comparably coated fabric which does not use an improved coating substrate in accordance with the present invention.

Thus, it is apparent that there has been provided in accordance with the present invention, a process for preparing an improved coating substrate that fully satisfies the objects, aims, and advantages set forth above. While the invention has been described in conjunction with specific embodiments thereof, it is apparent that many alternatives, modifications, and variations will be evident to those skilled in the art in light of the foregoing description. Accordingly, it is intended to embrace all such alternatives, modifications, and variations as fall within the scope and broad spirit of the following claims.

What is claimed is:

1. A process of preparing an improved coated fabric, comprising:

immersing a fabric in a liquid composition comprising a fluorochemical composition sufficient to impart an AATCC Spray Test rating of at least 70 to said fabric, expressing excess liquid from said fabric, drying and curing said fabric at an elevated temperature, coating said fabric with an aqueous coating material, and drying and curing said coating.

2. The process according to claim 1, wherein said fluorochemical composition is sufficient to impart an AATCC Spray Test water repellency rating of at least 80 to said fabric.

3. The process according to claim 1, wherein said fluorochemical composition is sufficient to impart an AATCC Spray Test water repellency rating of at least 90 to said fabric.

4. The process according to claim 1, wherein said aqueous coating material is a latex coating material.

5. The process according to claim 4, wherein said latex coating material is an acrylic latex coating material.

6. A process of preparing an improved coated fabric, consisting of:

immersing a greige fabric in a liquid composition comprising a fluorochemical composition sufficient to impart an AATCC Spray Test water repellency rating of at least 80 to said fabric, expressing excess liquid from said fabric, drying and curing said fabric at an elevated temperature, coating said fabric with an acrylic latex coating material, and drying and curing said coating.

7. The process according to claim 1, wherein said fabric is a greige fabric.

8. An improved coated fabric comprising a coating substrate comprising a greige fabric impregnated with a fluorochemical composition sufficient to impart an AATCC Spray Test water repellency rating of at least 80 to said fabric, such fabric coated with an aqueous coating material, said coating material not showing-through said substrate.

9. The improved coated fabric according to claim 8, wherein said aqueous coating material is an acrylic latex coating material, said acrylic latex coating not showing-through said substrate.

10. The improved coated fabric according to claim 8, wherein said coating substrate is a non-woven fabric.

11. The improved coated fabric according to claim 8, wherein said coating substrate is a non-woven fabric selected from the group consisting of 100% polyester non-woven fabric and polyester non-woven fabric containing up to 20% of non-polyester fiber.

12. The improved coated fabric according to claim 8, wherein said coating substrate is a non-woven fabric comprising a spunlaced polyester non-woven fabric having a fiber entanglement completeness of at least 0.5.

* * * * *